US012677973B2

(12) United States Patent
Zhou et al.

(10) Patent No.: US 12,677,973 B2
(45) Date of Patent: Jul. 14, 2026

(54) FOLDABLE RAIL FOR ELECTRIC OPENING-CLOSING CURTAIN

(71) Applicant: NINGBO LIYANG NEW MATERIAL COMPANY LIMITED, Ningbo (CN)

(72) Inventors: Yongqiang Zhou, Ningbo (CN); Xiaosong Wu, Ningbo (CN)

(73) Assignee: NINGBO LIYANG NEW MATERIAL COMPANY LIMITED, Ningbo (CN)

( * ) Notice: Subject to any disclaimer, the term of this patent is extended or adjusted under 35 U.S.C. 154(b) by 297 days.

(21) Appl. No.: 18/518,901

(22) Filed: Nov. 24, 2023

(65) Prior Publication Data

US 2024/0172886 A1 May 30, 2024

(30) Foreign Application Priority Data

Nov. 26, 2022 (CN) ..... 202211495285.1

(51) Int. Cl.
*A47H 1/04* (2006.01)
*A47H 5/032* (2006.01)

(52) U.S. Cl.
CPC ..... *A47H 1/04* (2013.01); *A47H 5/0325* (2013.01)

(58) Field of Classification Search
CPC . A47H 1/04; A47H 1/08; A47H 5/032; A47H 5/0325; A47H 5/09
See application file for complete search history.

(56) References Cited

U.S. PATENT DOCUMENTS 1,022,210 A * 4/1912 Thir ..... A47H 5/032 160/346
1,346,747 A * 7/1920 Hamilton ..... A47H 5/032 160/370
1,653,586 A * 12/1927 Remhof ..... A47H 5/02 160/344
1,723,913 A * 8/1929 Bono ..... A47H 5/032 160/370
1,786,052 A * 12/1930 Boye ..... A47H 5/032 160/126

(Continued)

FOREIGN PATENT DOCUMENTS

CN 2300342 Y * 12/1998

*Primary Examiner* — Daniel P Cahn
*Assistant Examiner* — John W Hanes, Jr.
(74) *Attorney, Agent, or Firm* — Juan Carlos A. Marquez; Marquez IP Law Office, PLLC

(57) ABSTRACT

A foldable rail for an electric opening-closing curtain incorporates a first rail provided with opposed first end and second end; the first end is connected to a primary transmission box; a first joint is sleeved on the second end; a second rail provided with opposed third end and fourth end; the third end is connected to a secondary transmission box; a second joint is sleeved on the fourth end; a connection piece connected to the first joint and the second joint that can rotate relative to the connection piece; a transmission component, one end of which connected to the primary transmission box and the other end to the secondary transmission box both in a winding way; the transmission component runs through the first rail, the first joint, the second joint and the second rail in sequence from the primary transmission box to the secondary transmission box.

9 Claims, 8 Drawing Sheets

(56) References Cited

U.S. PATENT DOCUMENTS 1,855,037 A * 4/1932 Vroom ..... A47H 5/032 160/126
3,192,995 A * 7/1965 Graber ..... A47H 5/032 24/129 R
3,269,454 A * 8/1966 Gill ..... A47H 5/0325 160/331
3,502,132 A * 3/1970 Hager ..... A47H 5/0325 160/331
4,240,489 A * 12/1980 Madsen ..... A47H 15/04 160/345
4,301,852 A * 11/1981 Comeau ..... A47H 5/032 160/126
4,667,353 A * 5/1987 Zeigler ..... A47K 3/286 160/84.01
4,827,199 A * 5/1989 Kaucic ..... A47H 5/0325 160/331
4,955,422 A * 9/1990 Irizarry ..... A47K 3/38 160/344
5,889,377 A * 3/1999 Mao ..... A47H 5/03 318/16
6,085,826 A * 7/2000 Maesaki ..... A47H 5/0325 160/331
6,827,121 B2 * 12/2004 Park ..... A47H 5/0325 160/331
7,615,713 B2 * 11/2009 Bardella ..... B60R 16/0215 174/152 G
7,927,027 B2 * 4/2011 Yamakose ..... F16M 11/2021 396/428
8,708,026 B2 * 4/2014 Graves ..... A47H 5/0325 160/330
8,993,891 B2 * 3/2015 Drane ..... H05K 5/03 174/152 G
9,445,683 B1 * 9/2016 Rochin ..... A47H 1/04
10,517,418 B2 * 12/2019 Wu ..... A47H 1/124
10,743,698 B1 * 8/2020 Chen ..... A47H 15/04
2004/0026049 A1 * 2/2004 Park ..... A47H 5/0325 160/331
2006/0150369 A1 * 7/2006 Baer ..... E05D 7/009 16/301
2008/0156951 A1 * 7/2008 Lin ..... A47H 1/104 248/261
2009/0313790 A1 * 12/2009 Schau ..... E05D 7/009 16/354
2010/0224332 A1 * 9/2010 Hibshman ..... A47H 5/0325 160/405
2010/0275822 A1 * 11/2010 Elford ..... A47B 3/00 108/115
2012/0246868 A1 * 10/2012 Hunt ..... H02G 3/22 16/2.1
2016/0316952 A1 * 11/2016 Wahl ..... F16M 13/027
2021/0345809 A1 * 11/2021 Yu ..... A47H 5/02
2021/0393067 A1 * 12/2021 Chen ..... A47H 3/10
2024/0172886 A1 * 5/2024 Zhou ..... A47H 1/04

* cited by examiner

FOLDABLE RAIL FOR ELECTRIC OPENING-CLOSING CURTAIN

TECHNICAL FIELD

The present disclosure relates to the field of curtain rail technologies and in particular to a foldable rail for an electric opening-closing curtain.

BACKGROUND

Most of the rails of the existing opening-closing curtains have a fixed length. Since the opening-closing curtains are usually mounted with a large width, the rails are accordingly lengthened, which is unfavorable for transportation and elevator handling. For the conventional manual opening-closing curtains, the rails of the opening-closing curtains are made into a telescoping structure such that the length of the rails can be shortened during transportation, bringing conveniences to the transportations. Nowadays, more and more manual opening-closing curtains are replaced by the electric ones. In the rails of the electric opening-closing curtains, a belt assembly is mounted to electrically open or close the curtains. The rotation of the belt assembly is driven by a motor to achieve opening or closing of the curtain without manual operation, making use more convenient and more intelligent. There are also some telescoping rails for the electric opening-closing curtains on the market. Since a belt assembly is mounted in the rails, its telescoping structure is made complex, leading to high production costs, tedious assembling process and troublesome telescoping operation. Therefore, it is urgent to address the problem of how to achieve quick adjustment to a length of a rail for an electric opening-closing curtain to facilitate handling and operation.

SUMMARY

For the above situations of the prior arts, the technical problem to be solved by the present disclosure is to provide a foldable rail for an electric opening-closing curtain, which can quickly shorten its length by folding, achieving simple structure, easy operation, easy handling and transportation.

In order to solve the above technical problems, the present disclosure employs the following technical solution: there is provided a foldable rail for an electric opening-closing curtain. The foldable rail comprises a first rail provided with opposed first end and second end. The first end is connected to a primary transmission box, and a first joint is sleeved on the second end. The foldable rail further comprises a second rail. The second rail is provided with opposed third end and fourth end. The third end is connected to a secondary transmission box, and a second joint is sleeved on the fourth end. The foldable rail further comprises a connection piece which is connected to the first joint and the second joint. The first joint and the second joint can rotate relative to the connection piece. The foldable rail further comprises a transmission component, one end of which is connected in a winding way to the primary transmission box and the other end is connected in a winding way to the secondary transmission box. Further, the transmission component runs through the first rail, the first joint, the second joint and the second rail in sequence along a direction from the primary transmission box to the secondary transmission box.

Furthermore, two groups of thread columns which are first thread columns and second thread columns are symmetrically disposed at both sides of the connection piece.

The first thread columns are connected to the first joint and the second thread columns are connected to the second joint.

Furthermore, a first connection groove connected to the second end of the first rail in a sleeved way is disposed at an end of the first joint, and the other end of the first joint extends to form two symmetrical first connection arms. A first thread hole cooperating with the corresponding first thread column is disposed on the first connection arms respectively. A second connection groove connected to the fourth end of the second rail in a sleeved way is disposed on one end of the second joint, and the other end of the second joint extends to form two symmetrical second connection arms, each of which is provided with a second thread hole cooperating with the corresponding second thread column.

Furthermore, the thread directions of the first thread columns and the second thread columns are opposite.

Furthermore, a 90° gear angle is disposed on an upper end of the first connection arms and a 90° right angle is disposed on a lower end of the first connection arms. A 90° gear angle is disposed on an upper end of the second connection arms and a 90° right angle is disposed on a lower end of the second connection arms. The gear angle on the first connection arms meshed correspondingly with a gear angle on the second connection arms. A center of circle of the gear angle on the first connection arms is overlapped with a center of circle of the corresponding first thread holes, and a center of circle of the gear angle on the second connection arms is overlapped with a center of circle of the corresponding second thread holes. When the first rail and the second rail are unfolded to be in one straight line, the right angle on the first connection arms is abutted against the right angle on the corresponding second connection arms. When the first rail and the second rail are folded to be in parallel, a distance between the right angle on the first connection arms and the right angle on the corresponding second connection arms is the largest. When the first rail and the second rail are folded up from the unfolded state, the gear angle on the first connection arms is always meshed with the gear angle on the corresponding second connection arms.

Furthermore, a first channel for the transmission component to run through is disposed in the first connection arms. The first channels are in communication with the first connection groove and located below the corresponding first thread holes. A second channel for the transmission component to run through is disposed in the second connection arms. The second channels are in communication with the second connection groove and located below the corresponding second thread holes. When the first rail and the second rail are unfolded to be in one straight line, the first channels are in communication with the corresponding second channels.

Furthermore, the transmission component comprises a wire rope and a belt. The belt is disposed in the first rail and connected to the primary transmission box in a winding way. The wire rope is disposed in the second rail and connected to the secondary transmission box in a winding way. Furthermore, both ends of the wire rope respectively run through the second channels and the first channels to correspondingly connect with both ends of the belt to form a closed loop.

Furthermore, two segments of hose are symmetrically sleeved on the wire rope at both sides of the connection piece. The two segments of hose are located inside the first channels and the corresponding second channels. When the first rail and the second rail are unfolded to be in one straight line, the two segments of hose are shaped like a straight line, and when the first rail and the second rail are folded to be in parallel, the two segments of hose are shaped like "U".

Furthermore, a first pulley block is disposed in the first rail and a second pulley block is disposed in the second rail. The first pulley block and the second pulley block are connected to the transmission component to achieve synchronous movement. The first pulley block and the second pulley block move toward each other.

Furthermore, at least one adjusting assembly for adjusting a length of the wire rope is disposed in the second pulley block. The adjusting assembly comprises a spring and a push block. A spring groove for accommodating the spring and the push block is disposed in the second pulley block. One end of the spring is abutted against an inner wall of the spring groove and the other end is abutted against the push block. The wire rope runs through an entry of the second pulley block and winds on the push block and then runs out of an exit of the second pulley block. The entry and the exit of the second pulley block are in a same straight line. The opening direction of the spring groove is perpendicular to the direction of the entry and the exit.

Furthermore, an odd number of adjusting assemblies are disposed in the second pulley block. A first adjusting assembly is near the entry, with the push block of the first adjusting assembly being at a side away from the entry; the push blocks in adjacent adjusting assemblies are disposed in opposite directions; a last adjusting assembly is near the exit, with the push block in the last adjusting assembly disposed in the same direction as that in the first adjusting assembly. The wire rope runs through the entry of the second pulley block and winds around the adjusting assemblies in "S" shape and then runs out of the exit of the second pulley block. When the first rail and the second rail are folded to be in parallel, the wire rope is tensioned, and the wire rope can squeeze the push blocks and hence compress the springs so as to shorten the distance between adjacent push blocks, and thus, the length of the wire rope is increased. When the first rail and the second rail are unfolded to be in one straight line, the wire rope is loosened, and the springs restore to increase the distance between adjacent push blocks, and hence shorten the length of the wire rope.

Furthermore, a detachable top cover for covering the adjusting assemblies is disposed on the second pulley block.

Compared with the prior arts, the present disclosure has the following advantages: in the present disclosure, the cooperative connection of the first rail, the first joint, the second rail and the second joint with the connection piece enables the first rail and the second rail to be rotatable with the connection piece as a hinging point, thereby achieving quick folding of the first rail and the second rail, and shortening the entire length, bringing convenient transportation and handling, simple operation and stable structure. Furthermore, little damage may be brought to the transmission component during the folding process.

BRIEF DESCRIPTIONS OF THE DRAWINGS

Figure 1:
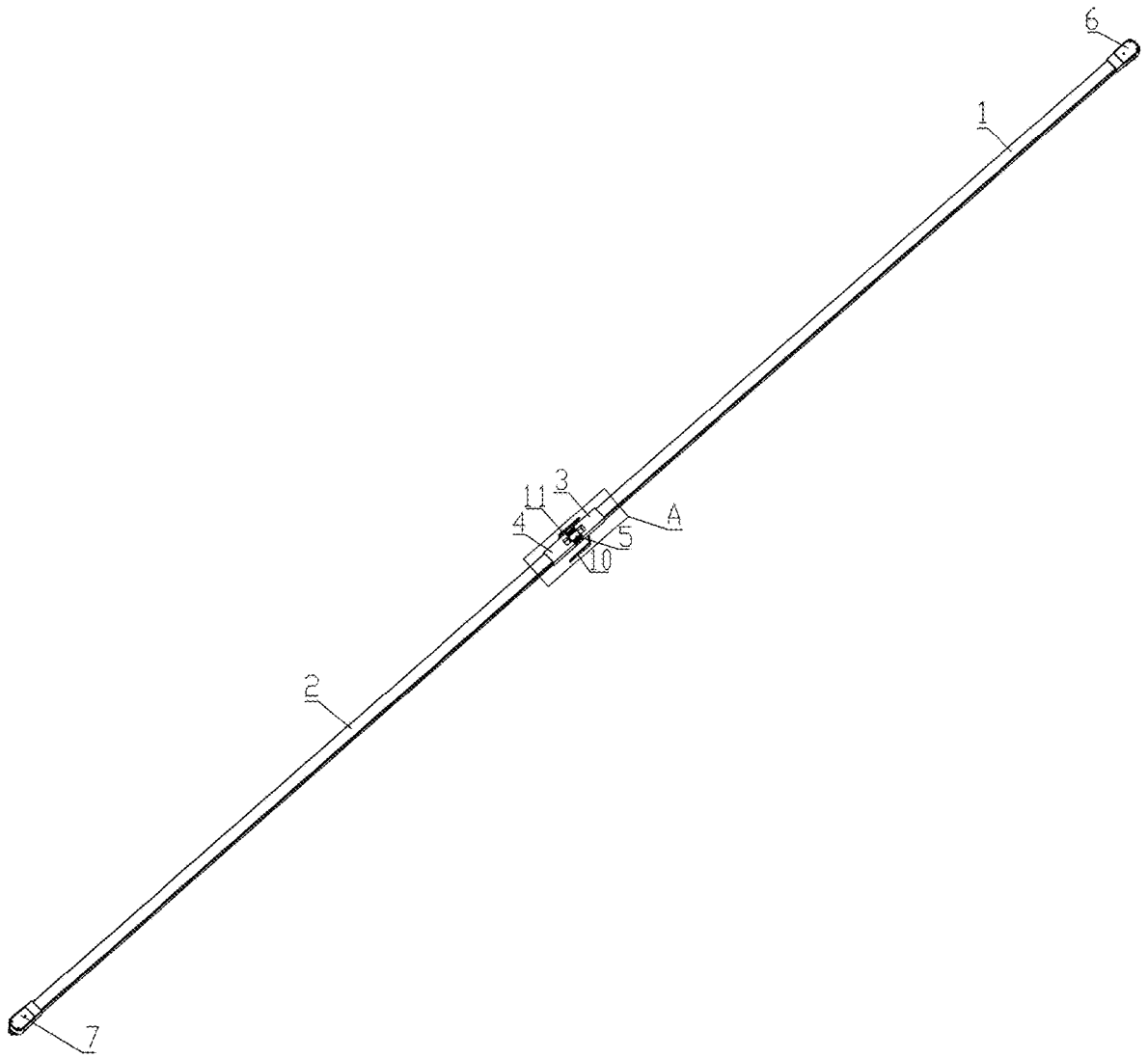
FIG. 1 is a structural schematic diagram of the present disclosure.

Numerals of the drawings are described below: 1. first rail, 1.1 first end, 1.2 second end, 1.3 through groove, 1.4 slide groove, 2. second rail, 2.1 third end, 2.2 fourth end, 2.3 through groove, 2.4 slide groove, 3. first joint, 3.1 first connection groove, 3.2 first connection arm, 3.3 first thread hole, 3.4 gear angle, 3.5 right angle, 3.6 first channel, 4. second joint, 4.1 second connection groove, 4.2 second connection arm, 4.3 second thread hole, 4.4 gear angle, 4.5 right angle, 4.6 second channel, 5. connection piece, 5.1 first thread column, 5.2 second thread column, 6. primary transmission box, 6.1 primary box body, 6.2 drive wheel, 7. secondary transmission box, 7.1 secondary box body, 7.2 driven wheel, 8. transmission assembly, 8.1 wire rope, 8.2 belt, 9. hose, 10. first pulley block, 11. second pulley block, 11.1 spring groove, 11.2 entry, 11.3 exit, 11.4 top cover, 12. adjusting assembly, 12.1 spring, 12.2 push block, 13. slide block, 13.1 connection portion.

DETAILED DESCRIPTIONS OF EMBODIMENTS

As shown in FIGS. 1 to 10, the present disclosure provides a foldable rail for an electric opening-closing curtain, which comprises a first rail 1. The first rail 1 is provided with opposed first end 1.1 and second end 1.2. The first end 1.1 is connected to a primary transmission box 6 which is connected to an output end of a motor. The motor in operation drives the primary transmission box 6. A first joint 3 is sleeved on the second end 1.2. The foldable rail further comprises a second rail 2. The second rail 2 is provided with opposed third end 2.1 and fourth end 2.2. The third end 2.1 is connected to a secondary transmission box 7, and a second joint 4 is sleeved on the fourth end 2.2. The foldable rail further comprises a connection piece 5 which is connected to the first joint 3 and the second joint 4. The first joint 3 and the second joint 4 can rotate relative to the connection piece 5. The foldable rail further comprises a transmission component 8, one end of which is connected in a winding way to the primary transmission box 6 and the other end is connected in a winding way to the secondary transmission box 7. Further, the transmission component 8 runs through the first rail 1, the first joint 3, the second joint 4 and the second rail 2 in sequence along a direction from the primary transmission box 6 to the secondary transmission box 7.

In the present disclosure, the first rail 1, the first joint 3, the second rail 2, and the second joint 4 can be cooperatively connected to the connection piece 5 in such a way that the first rail 1 and the second rail 2 can rotate with the connection piece 5 as a hinging point, so as to quickly fold the first rail 1 and the second rail 2. Thus, the entire length can be shortened to facilitate transportation and handling operation, leading to simple operation and stable structure. Further, little damage may be caused to the transmission component 8 during the folding process.

Figure 3:
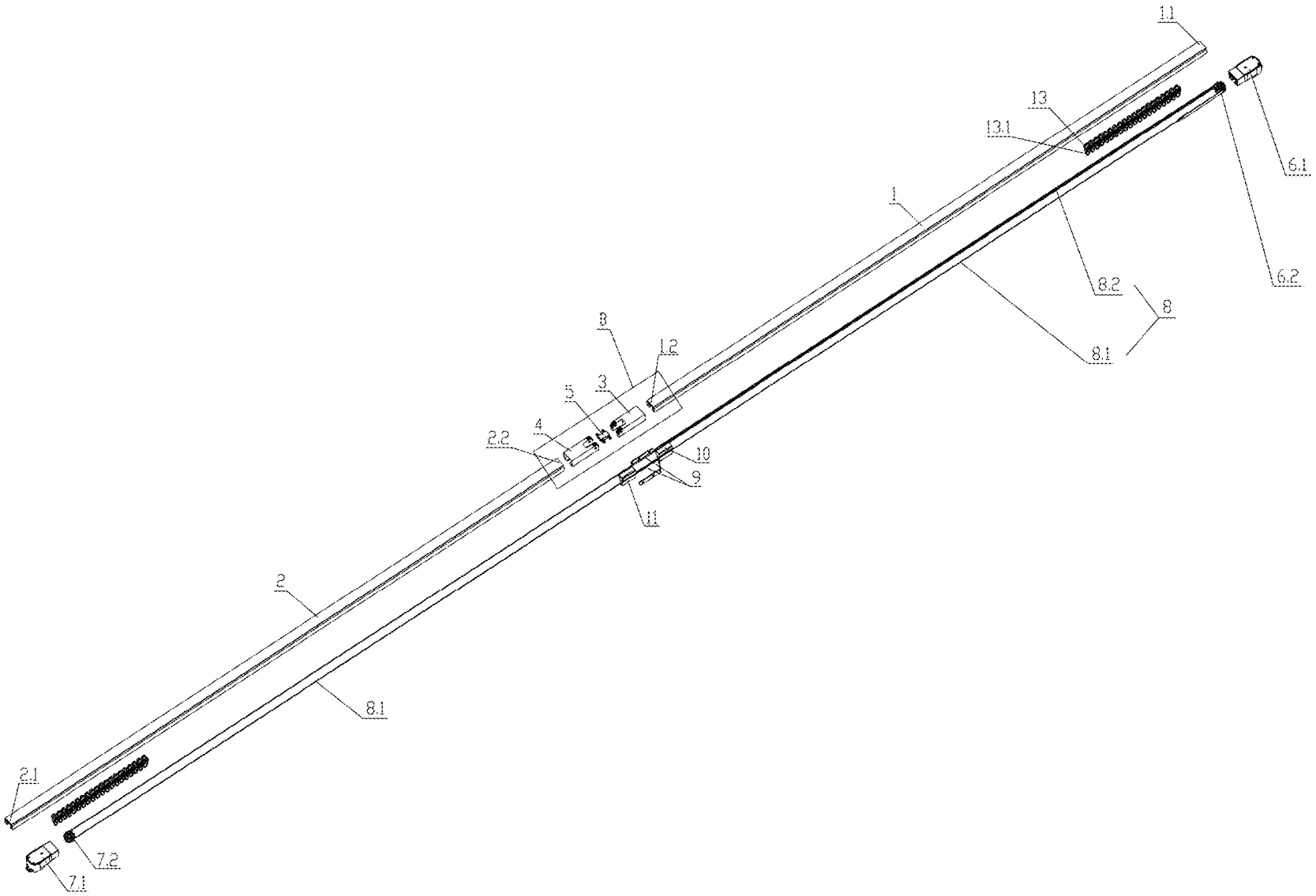
FIG. 3 is an exploded view of the present disclosure.
Figure 4:
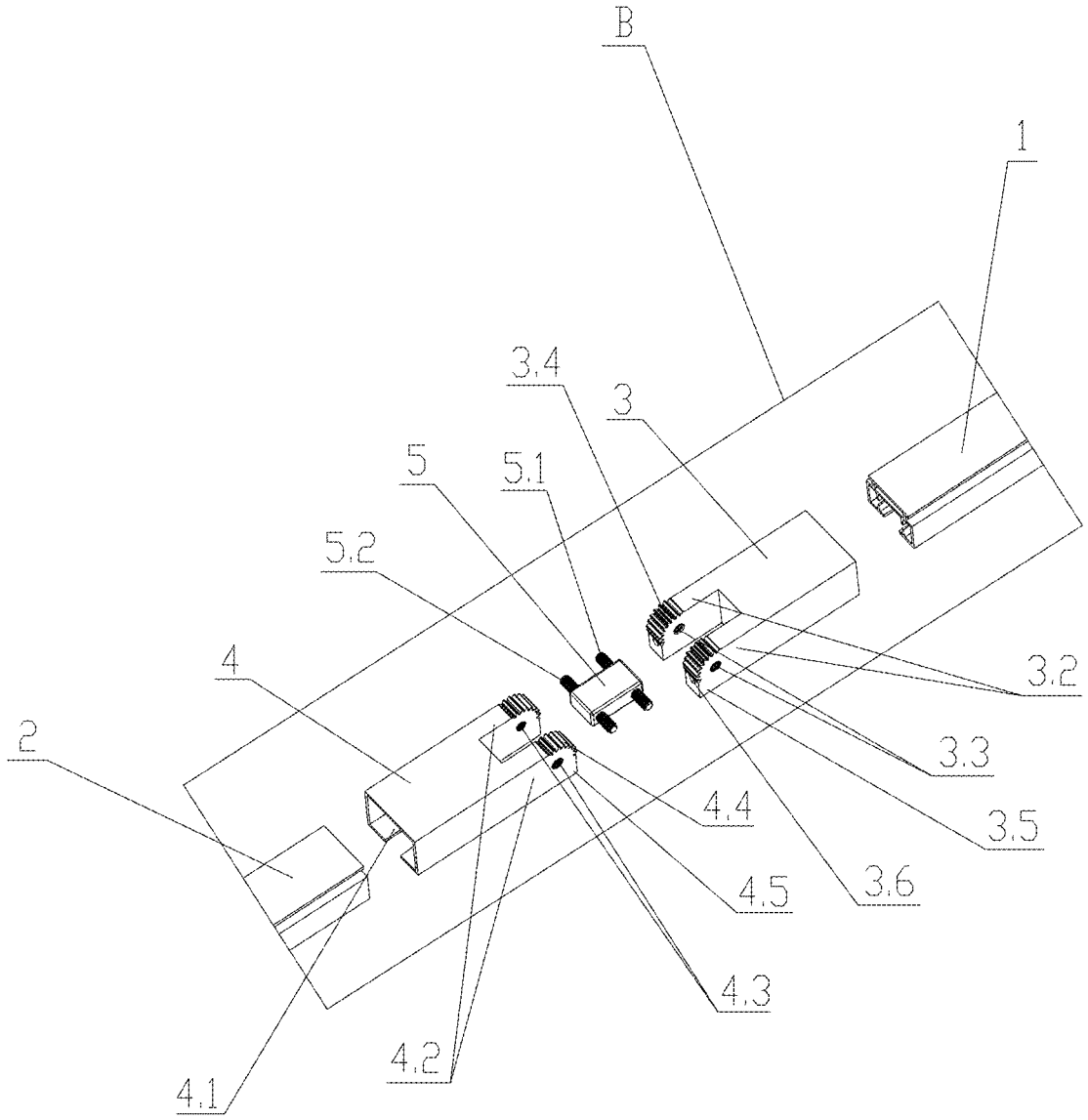
FIG. 4 is an enlarged view of the position B in FIG. 3.

As shown in FIGS. 3 and 4, in order to ensure the folding and unfolding stability of the foldable rail, two groups of thread columns which are first thread columns 5.1 and second thread columns 5.2 are symmetrically disposed at both sides of the connection piece 5. The first thread columns 5.1 are connected to the first joint 3 and the second thread columns 5.2 are connected to the second joint 4. With rotatable thread connection with the first thread columns 5.1 and the second thread columns 5.2, the rotatable folding will be more stable. Without the action of an external force, the first joint 3 and the second joint 4 are unable to freely rotate relative to the connection piece 5, achieving self-locking effect.

Figure 7:
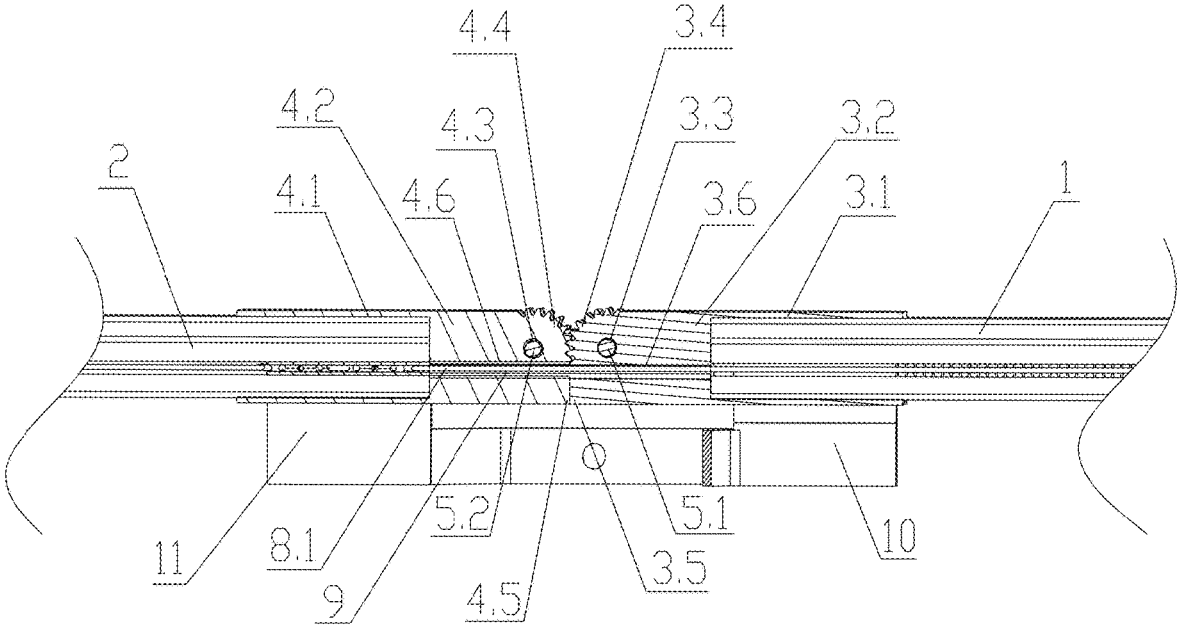
FIG. 7 is a partial sectional view of a connection position according to the present disclosure.

With reference to FIGS. 4 and 7, a first connection groove 3.1 connected to the second end 1.2 of the first rail 1 in a sleeved way is disposed at an end of the first joint 3, and the other end of the first joint 3 extends to form two symmetrical first connection arms 3.2. A first thread hole 3.3 cooperating with the corresponding first thread column 5.1 is disposed on the first connection arms 3.2 respectively. A second connection groove 4.1 connected to the fourth end 2.2 of the second rail 2 in a sleeved way is disposed on one end of the second joint 4, and the other end of the second joint 4 extends to form two symmetrical second connection arms 4.2, each of which is provided with a second thread hole 4.3 cooperating with the corresponding second thread column 5.2. With the extension disposal of the first connection arms 3.2 and the second connection arms 4.2, the connection piece 5 can be connected between the first joint 3 and the second joint 4 in a concealed way, making the entire structure more aesthetic. With the disposal of the first connection groove 3.1 and a second connection groove 4.1, the first rail 1 and the second rail 2 can be quickly assembled and disassembled, simplifying the assembling and disassembling process and improving the assembling efficiency. The first joint 3 and the second joint 4 are disposed in such a way that the first rail 1 and the second rail 2 can be quickly folded without directly being hinged to the connection piece 5, bringing conveniences to the assembling and disassembling process and simplifying the operations.

The thread directions of the first thread columns 5.1 and the second thread columns 5.2 are opposite. When the first rail 1 and the second rail 2 are unfolded to form one straight line, that is, when the first joint 3 and the second joint 4 rotate toward both ends of the connection piece 5 respectively until the first joint 3, the second joint 4 and the connection piece 5 are in one straight line, the first thread columns 5.1 are tightened into the first thread holes 3.3 and the second thread columns 5.2 are tightened into the second thread holes 4.3, so as to ensure the first rail 1 and the second rail 2 are stabilized without deformation, achieving good stability and safety. When the first rail 1 and the second rail 2 are folded to be in parallel, that is, when the first joint 3 and the second joint 4 rotate toward a central line of the connection piece 5 until the first joint 3, the second joint 4 and the connection piece 5 are shaped like "U", the first thread columns 5.1 are loosened from the first thread holes 3.3 and the second thread columns 5.2 are loosened from the second thread holes 4.3. Since the thread directions of the first thread columns 5.1 and the second thread columns 5.2 are opposite, it can be guaranteed that after the first rail 1 and the second rail 2 are unfolded, the first joint 3 and the second joint 4 can be tightly connected to the connection piece 5, making the structure more rugged and more stable. In this way, the curtain can be stably mounted.

Figure 2:
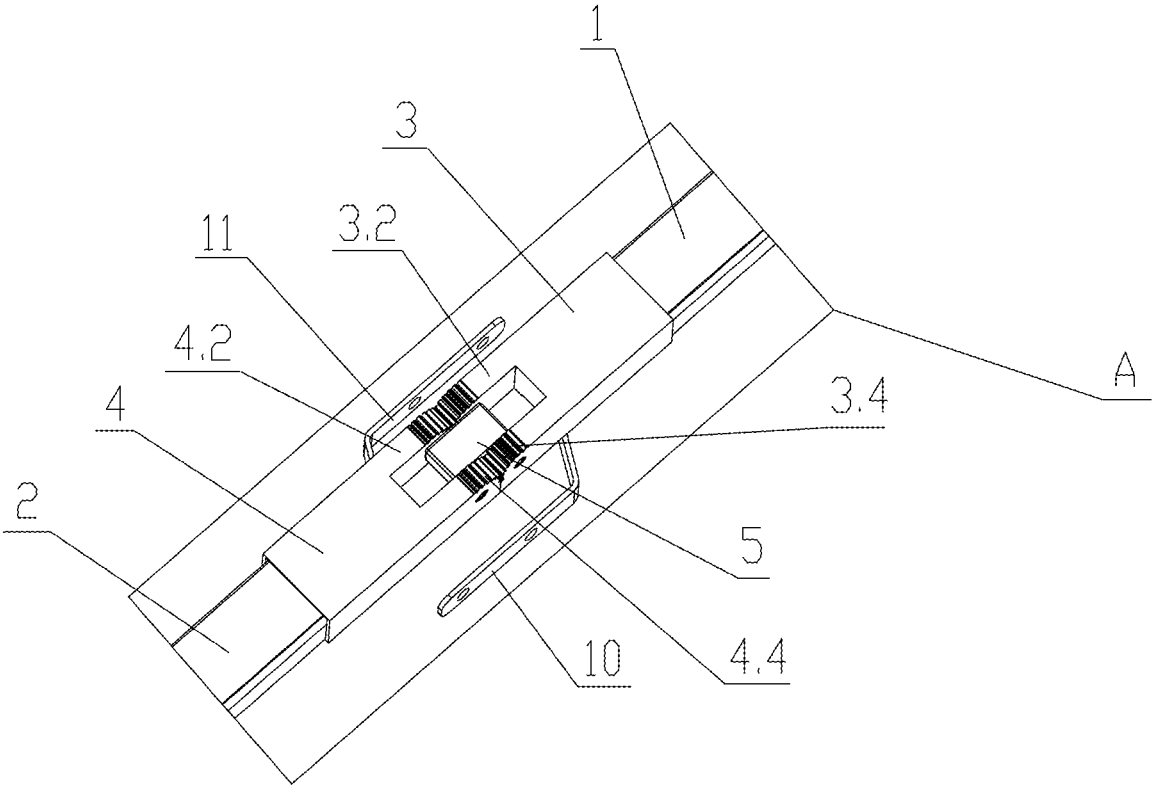
FIG. 2 is an enlarged view of the position A in FIG. 1.

With reference to FIGS. 2 and 4, a 900 gear angle 3.4 is disposed on an upper end of the first connection arms 3.2 and a 90° right angle is disposed on a lower end of the first connection arms 3.2. A 90° gear angle 4.4 is disposed on an upper end of the second connection arms 4.2 and a 900 right angle is disposed on a lower end of the second connection arms 4.2. The gear angle 3.4 on the first connection arms 3.2 meshed correspondingly with the gear angle 4.4 on the second connection arms 4.2. A center of circle of the gear angle 3.4 on the first connection arms 3.2 is overlapped with a center of circle of the corresponding first thread holes 3.3, and a center of circle of the gear angle 4.4 on the second connection arms 4.2 is overlapped with a center of circle of the corresponding second thread holes 4.3. When the first rail 1 and the second rail 2 are unfolded to be in one straight line, the right angle 3.5 on the first connection arms 3.2 is abutted against the right angle 4.5 on the corresponding second connection arms 4.2 to ensure the first rail 1 and the second rail 2 can be unfolded straightly and stably without any downward collapse. When the first rail 1 and the second rail 2 are folded to be in parallel, a distance between the right angle 3.5 on the first connection arms 3.2 and the right angle 4.5 on the corresponding second connection arms 4.2 is the largest. When the first rail 1 and the second rail 2 are folded up from the unfolded state, the gear angle 3.4 on the first connection arms 3.2 is always meshed with the gear angle 4.4 on the corresponding second connection arms 4.2. This structure can hold the first rail 1 and the second rail 2 closer to each other after they are folded up, thus saving space. For a general folding structure, there may be a large gap between the first rail 1 and the second rail 2 folded up, increasing its volume and packaging space. Further, the meshed rotation of the gear angles 3.4 and 4.4 ensures the first rail 1 and the second rail 2 can be attached to each other after being folded up, reducing the packaging space, lowering the transportation costs. Moreover, the folding and unfolding process will be more stable.

With reference to FIG. 7, a first channel 3.6 for the transmission component 8 to run through is disposed in the first connection arms 3.2. The first channels 3.6 are in communication with the first connection groove 3.1 and located below the corresponding first thread holes 3.3. A second channel 4.6 for the transmission component 8 to run through is disposed in the second connection arms 4.2. The second channels 4.6 are in communication with the second connection groove 4.1 and located below the corresponding second thread holes 4.3. When the first rail 1 and the second rail 2 are unfolded to be in one straight line, the first channels 3.6 are in communication with the corresponding second channels 4.6. The disposal of the first channels 3.6 and the second channels 4.6 helps the transmission component 8 to run through. Further, when the first rail 1 and the second rail 2 are unfolded to be in one straight line, the first channels 3.6 are in communication with the corresponding second channels 4.6 to ensure the transmission component 8 will not be exposed. Moreover, the disposal of the first channels 3.6 and the second channels 4.6 below the first thread holes 3.3 and the second thread holes 4.3 ensures the bending of the transmission component 8 will not be affected by the connection piece 5 when the first rail 1 and the second rail 2 are folded up.

With reference to FIG. 3, the transmission component 8 comprises a wire rope 8.1 and a belt 8.2. The belt 8.2 is disposed in the first rail 1 and connected to the primary transmission box 6 in a winding way. The wire rope 8.1 is disposed in the second rail 2 and connected to the secondary transmission box 7 in a winding way. Furthermore, both ends of the wire rope 8.1 respectively run through the second channels 4.6 and the first channels 3.6 to correspondingly connect with both ends of the belt 8.2 to form a closed loop. The transmission component 8 adopts the structure of the wire rope 8.1 spliced with the belt 8.2 because, on the one hand, the transmission of the belt 8.2 and the primary transmission box 6 is made more stable without any slip, and on the other hand, the wire rope 8.1 is more bendable than the belt 8.2 and can restore with less damage after being bent. As a result, both ends of the wire rope 8.1 respectively run through the second channels 4.6 and the first channels 3.6 to correspondingly connect with both ends of the belt 8.2, such that the belt 8.2 can be entirely located within the first rail 1 without bending when the first rail 1 and the second rail 2 are folded up. The two symmetrical segments of wire ropes 8.1 under the connection piece 5 are bent to facilitate the folding operation and bring little damage.

With reference to FIGS. 3 and 7, two segments of hose 9 are symmetrically sleeved on the wire rope 8.1 at both sides of the connection piece 5. The two segments of hose 9 are located inside the first channels 3.6 and the corresponding second channels 4.6. When the first rail 1 and the second rail 2 are unfolded to be in one straight line, the two segments of hose 9 are shaped like a straight line, and when the first rail 1 and the second rail 2 are folded to be in parallel, the two segments of hose 9 are shaped like "U". The two segments of hose 9 are sleeved on the bending positions of the wire rope 8.1 such that the wire rope 8.1 can be protected against deformation in a folding process, further reducing the damage to the wire rope 8.1 and extending its service life.

Figure 5:
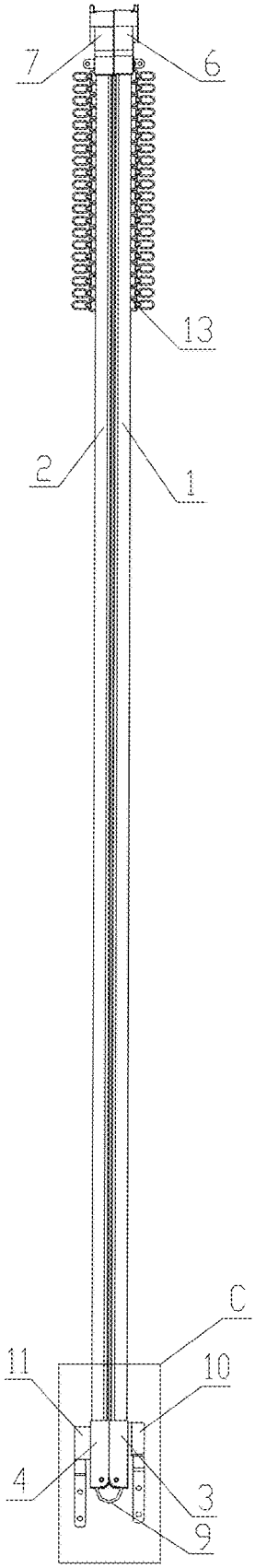
FIG. 5 is a schematic diagram illustrating a folded state according to the present disclosure.
Figure 6:
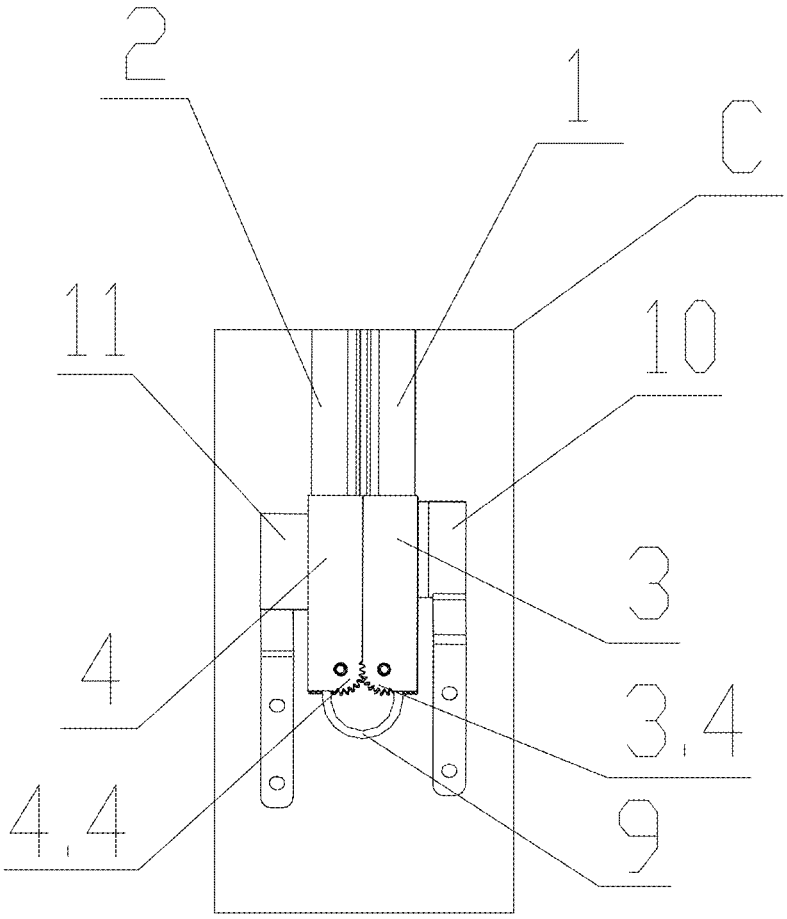
FIG. 6 is an enlarged view of the position C in FIG. 5.

With reference to FIGS. 1, 3, and 5, a first pulley block 10 is disposed in the first rail 1 and a second pulley block 11 is disposed in the second rail 2. The first pulley block 10 and the second pulley block 11 are connected to the transmission component 8 to achieve synchronous movement. The first pulley block 10 and the pulley block 11 move toward each other. The first pulley block 10 is used to connect with a head end of a curtain body in the first rail 1 to open or close the curtain body, and the second pulley block 11 is used to connect with a head end of the curtain body in the second rail 2 to open or close the curtain body. The first pulley block 10 and the second pulley block 11 synchronously move toward the connection piece 5 along with the movement of the transmission component 8 so as to unfold the curtain body or synchronously move in a direction away from the connection piece 5 to close the curtain body. The first pulley block 10 is slidably connected in the first rail 1 and fixedly connected at the connection position of the belt 8.2 and the wire rope 8.1, and the second pulley block 11 is slidably connected in the second rail 2 and moves in synchronization with the wire rope 8.1.

Figure 8:
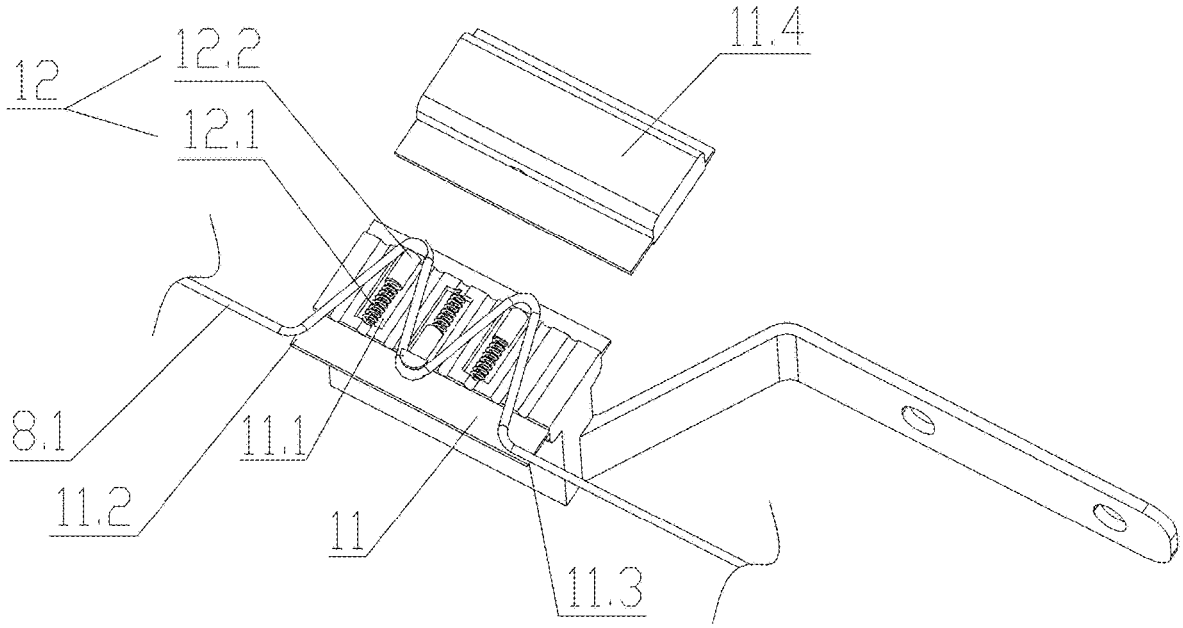
FIG. 8 is a split schematic diagram of a second pulley block according to the present disclosure.

With reference to FIG. 8, at least one adjusting assembly 12 for adjusting a length of the wire rope 8.1 is disposed in the second pulley block 11. The adjusting assembly 12 comprises a spring 12.1 and a push block 12.2. A spring groove 11.1 for accommodating the spring 12.1 and the push block 12.2 is disposed in the second pulley block 11. One end of the spring 12.1 is abutted against an inner wall of the spring groove 11.1 and the other end is abutted against the push block 12.2. The wire rope 8.1 runs through an entry 11.2 of the second pulley block 11 and winds on the push block 12.2 and then runs out of an exit 11.1 of the second pulley block 11. The entry 11.2 and the exit 11.3 of the second pulley block 11 are in a same straight line. The opening direction of the spring groove 11.1 is perpendicular to the direction of the entry 11.2 and the exit 11.3. With the structure, the wire rope 8.1 is wound and squeezed on the push block 12.2 and the push block 12.2 squeezes the spring 12.1 such that the wire rope 8.1 can be maintained in an elastically-adjustable state. Due to cooperation of the push block 12.2 and the spring 12.1, the wire rope 8.1 is run in "S" shape rather than directly straight through and thus the wire rope 8.1 has an elastically-stretching length. When the first rail 1 and the second rail 2 are folded up, the wire rope 8.1 can compensate the extension of the wire rope 8.1 resulting from the bending process by using the elastic stretching of the adjusting assembly 12, further protecting the wire rope 8.1 from damage and extending its service life.

Preferably, an odd number of adjusting assemblies 12, for example, one, or three or five adjusting assemblies, are disposed in the second pulley block 11. A first adjusting assembly is near the entry 11.2, with the push block 12.2 of the first adjusting assembly being at a side away from the entry 11.2; the push blocks 12.2 in adjacent adjusting assemblies 12 are disposed in opposite directions; a last adjusting assembly is near the exit 11.3, with the push block 12.2 in the last adjusting assembly disposed in the same direction as that in the first adjusting assembly. The wire rope 8.1 runs through the entry 11.2 of the second pulley block 11 straightly and winds around the adjusting assemblies 12 in "S" shape and then straightly runs out of the exit 11.3 of the second pulley block 11. In this case, the length of the wire rope 8.1 which originally should run straight through the entry 11.2 and the exit 11.3 can be increased, namely, the length of a part of the wire rope 8.1 located in the second pulley block 11 can be increased such that there is an elastically-stretching length. When the first rail 1 and the second rail 2 are folded to be in parallel, the wire rope 8.1 is tensioned, and the wire rope winding around the push blocks 12.2 in the second pulley block 11 can squeeze the push blocks 12.2 and hence compress the springs 12.1 so as to shorten the distance between adjacent push blocks 12.2, and thus, the length of the wire rope 8.1 in the second pulley block 11 is shortened. Therefore, the excess length can be used to compensate the extension of the wire rope 8.1 at the bending position and thus the wire rope 8.1 can be protected against bending damage. When the first rail 1 and the second rail 2 are unfolded to be in one straight line, the wire rope 8.1 is loosened, and the part of the wire rope 8.1 winding round the push blocks 12.2 in the second pulley block 11 has less squeeze on the push blocks 12.2 and thus the springs 12.1 restore to push the push blocks 12.2 outward so as to increase the distance between adjacent push blocks 12.2. In this way, the length of the wire rope 8.3 in the second pulley block 11 is increased to take back the length for compensating the extension of the wire rope 8.1 at the bending position, thereby protecting the wire rope 8.1 from damage during the bending process. Moreover, with the opposite disposal of adjacent adjusting assemblies 12, on one hand, the wire rope 8.1 is wound in "S" shape to increase the elastically-stretching length for compensating the extension of the wire rope 8.1 during the bending process, and one the other hand, the second pulley block 11 can move in synchronization with the wire rope 8.1 without any slip. In this case, the curtain body can be normally opened or closed.

A detachable top cover 11.4 for covering the adjusting assemblies 12 is disposed on the second pulley block 11 to facilitate assembling process.

Figure 9:
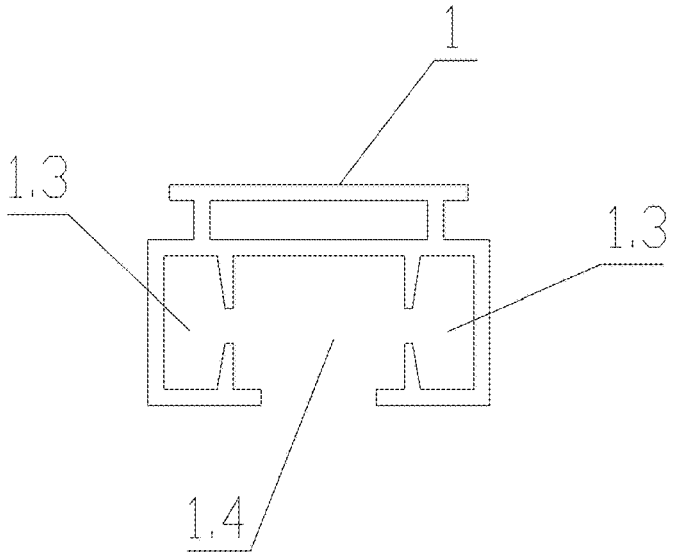
FIG. 9 is a side view of a first rail according to the present disclosure.
Figure 10:
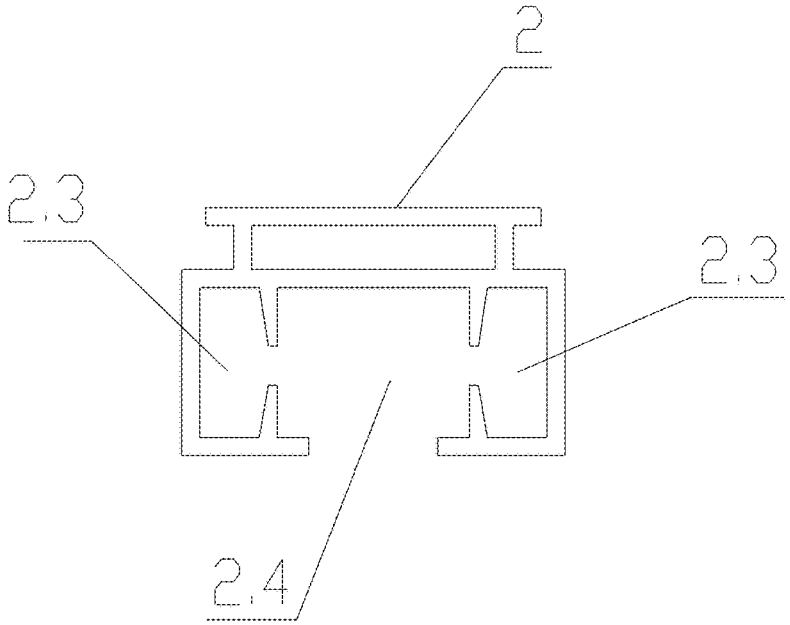
FIG. 10 is a side view of a second rail according to the present disclosure.

With reference to FIGS. 9 and 10, through grooves 1.3 and 2.3 for the transmission component 8 to run through are disposed at both sides of the first rail 1 and the second rail 2 respectively; and slide grooves 1.4 and 2.4 for mounting a slide block 13 are disposed between two through grooves 1.3 and 2.3 inside the first rail 1 and the second rail 2 respectively. A connection portion 13.1 for connecting the curtain body is disposed on the slide block 13. The slide grooves 1.4 and 2.4 are in communication with the corresponding through grooves 1.3 and 2.3 to facilitate the mounting of the first pulley block 10 and the second pulley block 11. The slide block 13 is respectively disposed between the first pulley block 10 and the primary transmission box 6 and between the second pulley block 11 and the secondary transmission box 7 respectively. Along with the movement of the first pulley block 10 and the second pulley block 11, the curtain body is drawn to slide each slide block 13. The primary transmission box 6 comprises a primary box body 6.1 detachably connected to the first rail 1 and a drive wheel 6.2 rotatably disposed in the primary box body 6.1 to drive the belt 8.2. The secondary transmission box 7 comprises a secondary box body 7.1 detachably connected to the second rail 2 and a driven wheel 7.2 rotatably disposed in the secondary box body 7.1 to drive the wire rope 8.1. The drive wheel 6.2 is in transmission connection with an output end of an external motor. When the motor is in operation, the rotation of the drive wheel is driven to drive the rotation of the belt 8.2 and the belt 8.2 thus drives the rotation of the wire rope 8.1. In this way, the first pulley block 10 and the second pulley block 11 are driven to open or close the curtain body.

When the first rail 1 and the second rail 2 are folded, a force may be applied to the first rail 1 and the second rail 2 respectively to enable the first rail 1 and the second rail 2 to be folded toward each other with the connection piece 5 as a hinging point until the first rail 1 and the second rail 2 are attached to each other as shown in FIG. 5. When the first rail 1 and the second rail 2 are folded, the first thread columns 5.1 and the second thread columns 5.2 on the connection piece 5 are respectively loosened from the first thread holes 3.3 and the second thread holes 4.3 in the first joint 3 and the second joint 4, and the gear angles 3.4 on the first joint 3 are and the corresponding gear angles 4.4 on the second joint 4 are always rotated while being meshed with each other. The hoses 9 in the first channels 3.6 and the second channels 4.6 protect the part of the wire rope 8.1 exposed due to bending to reduce folding deformation. In addition, when the springs 12.1 in the adjusting assemblies 12 in the second pulley block 11 are compressed, the elastically-stretching length of the wire rope 8.1 in the second pulley block 11 can compensate the extension of the wire rope 8.1 during a bending process. With the above structure, the length of the rails can be shortened by folding to facilitate transportation and handling, and the wire rope 8.1 can be protected against damage and folding deformation and thus can be used longer. Furthermore, the folding and unfolding process is stable and the structure is also stable. When the first rail 1 and the second rail 2 are unfolded, a force may be applied to the first rail 1 and the second rail 2 to enable the first rail 1 and the second rail 2 to unfold away from each other with the connection piece 5 as a hinging point, until the first rail 1 and the second rail 2 are in one straight line as shown in FIG. 1. The first thread columns 5.1 and the second thread columns 5.2 on the connection piece 5 are respectively tightened into the first thread holes 3.3 and the second thread holes 4.3 in the first joint 3 and the second joint 4, and the right angles 3.5 on the first joint 3 are abutted against the right angles 4.5 on the second joint 4 so as to avoid excessive unfolding. In this case, the hoses 9 retract into the first channels 3.6 and the second channels 4.6. Meanwhile, the springs 12.1 in the adjusting assemblies 12 in the second pulley block 11 restore to enable the wire rope 8.1 to elastically shrink, and thus the unfolded rail can be normally mounted and used. In this case, the structure is stable and firm, the operations in the folding and unfolding process are simple, and the length is shortened greatly, facilitating transportation and handling. Due to simple structure, it can be easily assembled and disassembled.

The materials, reagents and test instruments involved in the embodiments of the present disclosure are all commercially-available products in the field of curtain rails unless otherwise stated.

The invention claimed is:

1. A foldable rail for an electric opening-closing curtain, wherein the foldable rail comprises:

a first rail, provided with opposed first end and second end; the first end is connected to a primary transmission box, and a first joint is sleeved on the second end;

a second rail, provided with opposed third end and fourth end; the third end is connected to a secondary transmission box, and a second joint is sleeved on the fourth end;

a connection piece, which is connected to the first joint and the second joint; the first joint and the second joint can rotate relative to the connection piece;

a transmission component, one end of which is connected in a winding way to the primary transmission box and the other end is connected in a winding way to the secondary transmission box; the transmission component runs through the first rail, the first joint, the second joint and the second rail in sequence along a direction from the primary transmission box to the secondary transmission box, wherein two groups of thread columns which are first thread columns and second thread columns are symmetrically disposed at both sides of the connection piece; the first thread columns are connected to the first joint and the second thread columns are connected to the second joint, a first connection groove connected to the second end of the first rail in a sleeved way is disposed at an end of the first joint, and the other end of the first joint extends to form two symmetrical first connection arms; a first thread hole cooperating with the corresponding first thread column is disposed on the first connection arms respectively; a second connection groove connected to the fourth end of the second rail in a sleeved way is disposed on one end of the second joint, and the other end of the second joint extends to form two symmetrical second connection arms, each of which is provided with a second thread hole cooperating with the corresponding second thread column, and a 90° gear angle is disposed on an upper end of the first connection arms and a 90° right angle is disposed on a lower end of the first connection arms; a 90° gear angle is disposed on an upper end of the second connection arms and a 90° right angle is disposed on a lower end of the second connection arms; the gear angle on the first connection arms is meshed correspondingly with the gear angle on the second connection arms; a center of circle of the gear angle on the first connection arms is overlapped with a center of circle of the corresponding first thread holes, and a center of circle of the gear angle on the second connection arms is overlapped with a center of circle of the corresponding second thread holes; when the first rail and the second rail are unfolded to be in one straight line, the right angle on the first connection arms is abutted against the right angle on the corresponding second connection arms; when the first rail and the second rail are folded to be in parallel, a distance between the right angle on the first connection arms and the right angle on the corresponding second connection arms is the largest; when the first rail and the second rail are folded up from the unfolded state, the gear angle on the first connection arms is always meshed with the gear angle on the corresponding second connection arms.

2. The foldable rail for an electric opening-closing curtain of claim 1, wherein the thread directions of the first thread columns and the second thread columns are opposite.

3. A foldable rail for an electric opening-closing curtain, wherein the foldable rail comprises:

a first rail, provided with opposed first end and second end; the first end is connected to a primary transmission box, and a first joint is sleeved on the second end;

a second rail, provided with opposed third end and fourth end; the third end is connected to a secondary transmission box, and a second joint is sleeved on the fourth end;

a connection piece, which is connected to the first joint and the second joint; the first joint and the second joint can rotate relative to the connection piece;

a transmission component, one end of which is connected in a winding way to the primary transmission box and the other end is connected in a winding way to the secondary transmission box; the transmission component runs through the first rail, the first joint, the second joint and the second rail in sequence along a direction from the primary transmission box to the secondary transmission box, wherein two groups of thread columns which are first thread columns and second thread columns are symmetrically disposed at both sides of the connection piece; the first thread columns are connected to the first joint and the second thread columns are connected to the second joint, a first connection groove connected to the second end of the first rail in a sleeved way is disposed at an end of the first joint, and the other end of the first joint extends to form two symmetrical first connection arms; a first thread hole cooperating with the corresponding first thread column is disposed on the first connection arms respectively; a second connection groove connected to the fourth end of the second rail in a sleeved way is disposed on one end of the second joint, and the other end of the second joint extends to form two symmetrical second connection arms, each of which is provided with a second thread hole cooperating with the corresponding second thread column, and a first channel for the transmission component to run through is disposed in the first connection arms; the first channels are in communication with the first connection groove and the first channels are located below the corresponding first thread holes; a second channel for the transmission component to run through is disposed in the second connection arms; the second channels are in communication with the second connection groove and located below the corresponding second thread holes; when the first rail and the second rail are unfolded to be in one straight line, the first channels are in communication with the corresponding second channels.

4. The foldable rail for an electric opening-closing curtain of claim 3, wherein the transmission component comprises a wire rope and a belt; the belt is disposed in the first rail and connected to the primary transmission box in a winding way; the wire rope is disposed in the second rail and connected to the secondary transmission box in a winding way; both ends of the wire rope respectively run through the second channels and the first channels to correspondingly connect with both ends of the belt to form a closed loop.

5. The foldable rail for an electric opening-closing curtain of claim 4, wherein two segments of hose are symmetrically sleeved on the wire rope at both sides of the connection piece; the two segments of hose are located inside the first channels and the corresponding second channels; when the first rail and the second rail are unfolded to be in one straight line, the two segments of hose are shaped like a straight line, and when the first rail and the second rail are folded to be in parallel, the two segments of hose are shaped like "U".

6. The foldable rail for an electric opening-closing curtain of claim 4, wherein a first pulley block is disposed in the first rail and a second pulley block is disposed in the second rail; the first pulley block and the second pulley block are connected to the transmission component to achieve synchronous movement; the first pulley block and the second pulley block move toward each other.

7. The foldable rail for an electric opening-closing curtain of claim 6, wherein at least one adjusting assembly for adjusting a length of the wire rope is disposed in the second pulley block; the adjusting assembly comprises a spring and a push block; a spring groove for accommodating the spring and the push block is disposed in the second pulley block; one end of the spring is abutted against an inner wall of the spring groove and the other end is abutted against the push block; the wire rope runs through an entry of the second pulley block and winds on the push block and then runs out of an exit of the second pulley block; the entry and the exit of the second pulley block are in a same straight line; the opening direction of the spring groove is perpendicular to the direction of the entry and the exit.

8. The foldable rail for an electric opening-closing curtain of claim 7, wherein an odd number of adjusting assemblies are disposed in the second pulley block; a first adjusting assembly is near the entry, with the push block of the first adjusting assembly being at a side away from the entry; the push blocks in adjacent adjusting assemblies are disposed in opposite directions; a last adjusting assembly is near the exit, with the push block in the last adjusting assembly disposed in the same direction as that in the first adjusting assembly; the wire rope runs through the entry of the second pulley block and winds around the adjusting assemblies in "S" shape and then runs out of the exit of the second pulley block; when the first rail and the second rail are folded to be in parallel, the wire rope is tensioned, and the wire rope can squeeze the push blocks and compress the springs to shorten the distance between adjacent push blocks, and the length of the wire rope is increased; when the first rail and the second rail are unfolded to be in one straight line, the wire rope is loosened, and the springs restore to increase the distance between adjacent push blocks, and shorten the length of the wire rope.

9. The foldable rail for an electric opening-closing curtain of claim 8, wherein a detachable top cover for covering the adjusting assemblies is disposed on the second pulley block.

* * * * *